US008454758B2

(12) United States Patent
Akiba

(10) Patent No.: US 8,454,758 B2
(45) **Date of Patent: *Jun. 4, 2013**

(54) ELECTROSTATIC CHUCK CLEANING METHOD

(75) Inventor: Fuminori Akiba, Narita (JP)

(73) Assignee: Applied Materials, Inc., Santa Clara, CA (US)

( * ) Notice: Subject to any disclaimer, the term of this patent is extended or adjusted under 35 U.S.C. 154(b) by 1814 days.

This patent is subject to a terminal disclaimer.

(21) Appl. No.: 11/332,706

(22) Filed: Jan. 13, 2006

(65) Prior Publication Data

US 2006/0112970 A1 Jun. 1, 2006

Related U.S. Application Data

(63) Continuation of application No. 10/096,068, filed on Mar. 12, 2002, now Pat. No. 7,004,180.

(30) Foreign Application Priority Data

Mar. 19, 2001 (JP) ..... P2001-079131

(51) Int. Cl.
*B08B 7/00* (2006.01)
*B08B 7/04* (2006.01)

(52) U.S. Cl.
USPC ..... 134/26; 134/1; 134/1.1; 134/6

(58) Field of Classification Search
USPC ..... 134/1, 1.1, 26, 6, 902; 438/905
See application file for complete search history.

(56) References Cited

U.S. PATENT DOCUMENTS

| | | | | |
|---|---|---|---|---|
| 4,668,338 | A | 5/1987 | Maydan et al. | |
| 4,842,683 | A | 6/1989 | Cheng et al. | |
| 5,410,122 | A * | 4/1995 | Su et al. | 219/121.44 |
| 5,507,874 | A | 4/1996 | Su et al. | |
| 5,584,938 | A * | 12/1996 | Douglas | 134/1.3 |
| 5,671,119 | A | 9/1997 | Huang et al. | |
| 5,746,928 | A | 5/1998 | Yen et al. | |
| 5,858,108 | A * | 1/1999 | Hwang | 134/1.3 |
| 5,861,086 | A | 1/1999 | Khurana et al. | |
| 5,911,833 | A | 6/1999 | Denison et al. | |
| 5,946,184 | A * | 8/1999 | Kanno et al. | 361/234 |
| 6,101,967 | A | 8/2000 | Glass et al. | |
| 6,136,211 | A | 10/2000 | Qian et al. | |
| 6,166,432 | A | 12/2000 | Ohno et al. | |
| 6,240,931 | B1 * | 6/2001 | Fujii et al. | 134/1 |
| 6,242,364 | B1 | 6/2001 | Gurer et al. | |
| 6,243,251 | B1 | 6/2001 | Kanno et al. | |
| 6,252,758 | B1 | 6/2001 | Nagao et al. | |
| 6,256,825 | B1 | 7/2001 | Hwang | |
| 6,258,728 | B1 | 7/2001 | Donohoe et al. | |

(Continued)

FOREIGN PATENT DOCUMENTS

| | | |
|---|---|---|
| JP | 8-64573 | 3/1996 |
| JP | 2000-26913 | 1/2000 |

*Primary Examiner* — Alexander Markoff
(74) *Attorney, Agent, or Firm* — Patterson & Sheridan, LLP

(57) ABSTRACT

An electrostatic chuck cleaning process that cleans an electrostatic chuck, equipped in a chamber, for chucking and holding a substrate. This method has a plasma etching process that performs plasma etching on the electrostatic chuck, a substrate mounting process that mounts a substrate on the electrostatic chuck that was subjected to plasma etching in the plasma etching process, and a substrate removal process that removes the substrate that was mounted on the electrostatic chuck in the substrate mounting process.

5 Claims, 3 Drawing Sheets

U.S. PATENT DOCUMENTS 6,328,041 B1 12/2001 Brown et al.
6,397,861 B1 6/2002 Wing et al.
6,425,953 B1 7/2002 Johnson
6,526,997 B1 3/2003 Henley

* cited by examiner

ELECTROSTATIC CHUCK CLEANING METHOD

CROSS-REFERENCE TO RELATED APPLICATIONS

This application is a continuation of U.S. patent application Ser. No. 10/096,068, filed Mar. 12, 2002, now U.S. Pat. No. 7,004,180 which is incorporated by reference herein.

BACKGROUND OF THE INVENTION

1. Field of the Invention

This invention pertains to cleaning methods for electrostatic chucks.

2. Description of the Related Art

Semiconductor manufacturing apparatus such as sputtering apparatus is generally equipped with a low-pressure chamber, wherein is disposed a substrate support equipment to support a substrate such as a semiconductor wafer. The substrate support equipment is equipped with a base member that contains a heater or a cooler, and an electrostatic chuck, equipped on top of the base member, to which a voltage is applied to adhere and hold the semiconductor wafer through a coulomb force.

In semiconductor wafer processing using this type of substrate support equipment, processes such as the fabrication of metal films on the semiconductor wafer using, for example, sputtering processes, are performed after the semiconductor wafer is adhered to the electrostatic chuck. However, contaminants adhere to, and accumulate on, the electrostatic chuck as the semiconductor wafer process is performed repeatedly. As the contaminants accumulate, the force by which the electrostatic chuck is able to adhere the semiconductor wafer is weakened, leading to the risk that the wafer may shift out of position. Consequently the electrostatic chuck must be cleaned to remove the contaminants each time the semiconductor wafer process, is repeated a specific number of times.

Although a process of opening the chamber and manually wiping with a solvent to remove contaminants from the electrostatic chuck can be envisioned as a method for cleaning the electrostatic chuck, this method requires the chamber to be opened and the electrostatic chuck to be cooled to about room temperature, thus making the removal of the contaminants require an extended period of time, preventing the cleaning process from being performed efficiently.

In contrast, a method known as "cycle purging," wherein the contaminants are removed by the flow of the bulk gas by repetitively venting the bulk gas in the chamber and then drawing a rough vacuum, has been envisioned as a method for cleaning the Cleo electrostatic chuck without opening the chamber. As the result of researching the conventional technologies described above, the inventors discovered challenges as described below. In other words, even in a cleaning method using cycle purging, described above, the electrostatic chuck must still be cooled to a temperature of 100° C. or below when the cleaning is performed, so the removal of the contaminants still takes time, preventing efficiency in the cleaning, and it has not been possible to remove the contaminants adequately from the electrostatic chuck.

Given this, the object of this invention is to provide an electrostatic chuck cleaning method wherein the removal of contaminants from the electrostatic chuck is performed both efficiently and completely.

SUMMARY OF THE INVENTION

This invention is an electrostatic chuck cleaning method that cleans an electrostatic chuck for chucking and holding a substrate, equipped in a chamber. This method comprises (1) a plasma etching process wherein plasma etching is performed on the electrostatic chuck, (2) a substrate mounting process wherein a substrate is mounted onto the electrostatic chuck that has been plasma etched in the plasma etching process, and (3) a substrate removal process wherein the substrate that was mounted onto the electrostatic chuck in the substrate mounting process is removed.

In this method, plasma etching is performed on the electrostatic chuck in the plasma etching process in order to detach from the electrostatic chuck the contaminants adhered to the electrostatic chuck. Next, in the substrate mounting process, a substrate is mounted onto the electrostatic chuck, on which the detached contaminants remain, to cause the contaminants to adhere to the substrate. Then, in the substrate removal process, the substrate to which the contaminants are adhered is removed, removing the contaminants from the electrostatic chuck along with the substrate. In this method, the contaminants are detached from the electrostatic chuck by plasma etching, and the contaminants that had been adhered onto the electrostatic chuck can be removed sufficiently by causing them to adhere to the substrate and removing the substrate. Additionally, because it is not necessary to open the chamber and not necessary to cool the electrostatic chuck, the electrostatic chuck can be cleaned extremely efficiently.

In the substrate mounting process in the electrostatic chuck cleaning method according to the present invention, it is preferable for the substrate to be mounted on the electrostatic chuck in such a way that the mirror polish surface of the substrate faces the electrostatic chuck. Doing this makes it easier for the contaminants that have been detached from the electrostatic chuck to adhere to the substrate, increasing the efficiency with which the contaminants are removed.

Additionally, the substrate mounting process in the electrostatic chuck cleaning method according to this invention can include a substrate chucking process wherein a voltage is applied to the electrostatic chuck to chuck the substrate. Doing so makes it easier for the contaminants that have been detached from the electrostatic chuck to adhere to the substrate, increasing the efficiency with which the contaminants are removed.

Additionally, the electrostatic chuck cleaning method according to this invention may also have a repeat process wherein the substrate mounting process and the substrate removal process is repeated. In this way, a plurality of substrates can be mounted sequentially and removed sequentially, fully removing, along with the plurality of wafers, the contaminants that have been detached from the electrostatic chuck.

The electrostatic chuck according to the present invention preferably has a repeat process wherein the substrate mounting process and the substrate removal process are repeated and, preferably, in the substrate chucking process in the substrate mounting process, the direction of the voltage which is applied to the electrostatic chuck is reversed each time a new substrate is mounted on the electrostatic chuck in the repeat process. In this way, it is possible to fully remove, along with the plurality of substrates, the contaminants that have been detached from the electrostatic chuck, by sequentially mounting multiple substrates and sequentially removing multiple substrates. In addition, while the contaminants that are detached from the electrostatic chuck by the plasma etching are charged with either a positive or negative polarity, by reversing, each time a new substrate is mounted in the repeat process, the direction of the voltage that is applied to the electrostatic chuck, it is possible to cause the contaminants, regardless of the type of their charge, to adhere to the substrate, making it possible to remove the contaminants with the substrate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
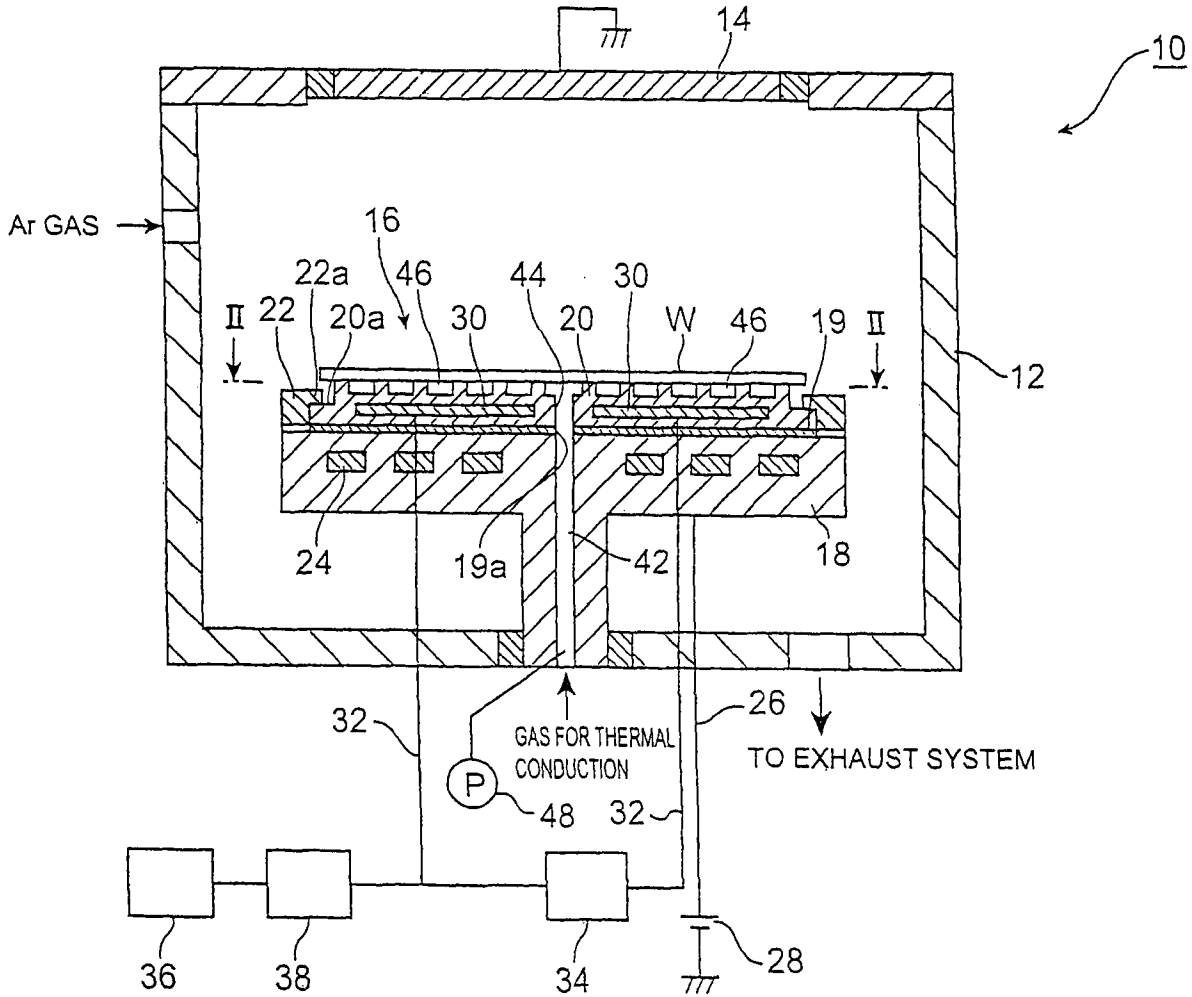
FIG. 1 is a structural drawing showing, schematically, a sputtering apparatus that is able to perform well the electrostatic chuck cleaning process according to the present invention.

A detailed description of an embodiment of the present invention, referencing the attached drawings, will be provided below. Note that in the drawings, similar elements are labeled with the same numbers, so redundant explanations will be omitted.

FIG. 1 is a structural drawing showing, schematically, a sputtering apparatus that is able to perform well the electrostatic chuck cleaning method according to the present invention. As is shown in the figure, the sputtering apparatus 10 is equipped with a processing chamber 12, in which a vacuum has been established, and a target 14, which serves as a cathode, equipped in the top part of said processing chamber 12.

A substrate support equipment 16 for supporting a semiconductor wafer (substrate) W, such as a Si wafer, is also provided in the processing chamber 12. The substrate support equipment 16 is provided parallel to and facing the target 14. The substrate support equipment is provided equipped with a base member 18 that serves as an anode and has a circular horizontal cross section. The substrate support equipment is provided with an electrostatic chuck 20 that has a circular horizontal cross section that holds the semiconductor wafer W through chucking and which is provided on the top of said base member 18 and top of a heat-conducting sheet 19 provided thereon, and is provided with a ring-shaped holder 22 for securing the aforementioned electrostatic chuck 20 to the base member 18.

A step part 20*a* is formed around the edge of the electrostatic chuck 20, where the electrostatic chuck 20 is secured to the base member 18 by bolting the holder 22 to the base member 18 while a rib part 22*a* equipped on the inner surface of the holder 22 is resting on the step part 20*a*.

The base member 18 is fabricated from a metal such as stainless steel, and it contains nickel chromium wires 24 as a heater. Furthermore, this base member 18 is connected to a DC power supply 28 by electrical lead wires 26, where a plasma is generated between the target 14, as the cathode, and the base member 18, as the anode, when the DC power supply 28 powers the base member 18.

The electrostatic chuck 20 is made from a ceramic such as alumina. The electrostatic chuck 20 is equipped internally with a pair of electrodes 30, where this pair of electrodes 30 is connected to a DC power supply 34 through electrical lead wires 32. When power is applied to this pair of electrodes 30 from the DC power supply 34, a coulomb force is generated between electrostatic chuck 20 and the semiconductor wafer W, causing the semiconductor wafer W to be chucked by the electrostatic chuck 20.

Additionally, the pair of electrodes 30 of the static chuck 20 is connected through the electrical lead wires 32 to an RF rectifier circuit 38 and a high frequency power supply 36 for cleaning the electrostatic chuck 20.

The base member 18 is equipped with a gas introduction conduit 42 that carries a gas for thermal conduction, supplied from a gas supply, not shown. This gas conduit 42 extends in the direction that is perpendicular to the center of the base member 18, and is open at the top.

Figure 2:
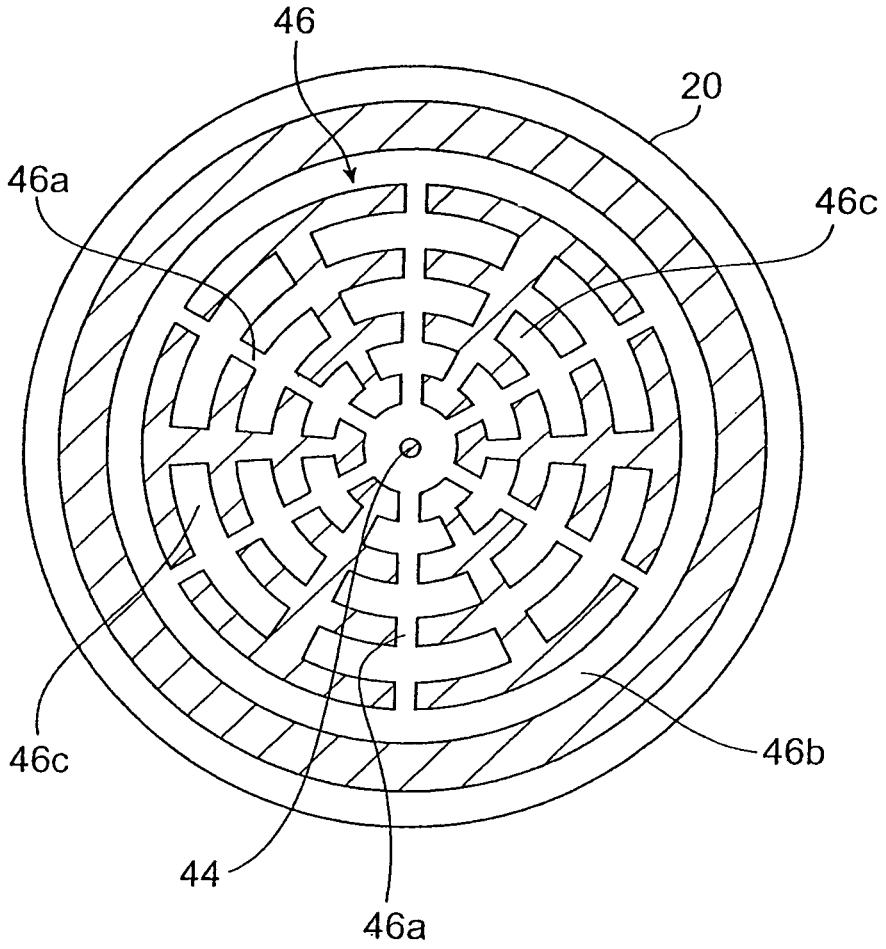
FIG. 2 is a cross-sectional drawing along the line II-II in FIG. 1.

The electrostatic chuck 20 is equipped with a gas introduction conduit 44 that connects to the gas introduction conduit 42, extending in a direction perpendicular at the center part, and opening at the top. On the top surface of the chuck 20 there are gas reservoir grooves 46, which are connected to the gas introduction conduit 44, in order to hold the gases for thermal conduction that are introduced from said gas conduit 44. The gas reservoir grooves 46, as shown in FIG. 2, are structured from a plurality of linear groove parts 46*a* that are connected to the gas introduction conduit 44 and extend in the radial direction, a ring-shaped groove 46*b* that is connected to the linear grooves 46*a*, and a plurality of arced grooves 46*c* that have end parts and that are formed on the inside of the ring-shaped groove 46*b*. Because the gas reservoir grooves 46 are structured in this way from the linear grooves 46*c*, the gas for thermal conduction is supplied efficiently from the gas introduction conduit 46 to the entire semiconductor wafer W ranging from the inner portions to the outer portions thereof.

Note that a pressure gauge 48 for measuring the supply pressure of the gas for thermal conduction is attached to the gas introduction conduit 42.

The thermally conductive sheet 19 is fabricated from a metal with elasticity, such as aluminum, and it is equipped in its center with gas introduction hole 19*a* connected to the gas introduction conduits 42 and 44.

The cleaning method for the electrostatic chuck 20 will be explained for the case wherein film fabrication processes using the sputtering apparatus 10, structured as described above, are performed repetitively.

In these film fabrication processes, the semiconductor wafer W, such as a silicon wafer, is introduced into the process chamber 12 and placed on a specific location on the electrostatic chuck 20. Next a voltage is applied to the pair of electrodes 30 in the electrostatic chuck 20 by the DC power supply 34, securing the semiconductor wafer W to the electrostatic chuck 20.

After this, the gas for thermal conduction is supplied from a gas supply, not shown, through the gas introduction conduit 42, the gas introduction hole 19*a*, and the gas introduction hole 44, to the gas reservoir grooves 46. This efficiently increases the temperature of the semiconductor wafer W. The temperature of the semiconductor wafer W is set at approximately 500 to 600° C. Note that various gases can be used as a gas for thermal conduction, gasses such as helium gas, argon gas, nitrogen gas, or other gases with superior thermal transfer efficiencies.

Next a vacuum exhaust system connected to the process chamber 12 is activated, reducing the pressure within the process chamber 12 to a specific vacuum level. Argon gas (Ar gas) is introduced into the process chamber 12, while, at the same time, the DC power supply 28 is activated to apply power between the base member 18 as the anode, and the target 14 as the cathode. When this is done, a plasma discharge is formed between the base member 18 and the target 14, the argon ions impinge on the target 14, and the particles that are sputtered thereby build up on the semiconductor wafer W to form a thin film.

After this type of film fabrication process has been performed a specific number of times, for example, after processing 1000 to 2000 of the semiconductor wafers W, cleaning is performed on the electrostatic chuck 20. As the film fabrication process described above is repeated, contaminants will adhere to, and build up on, the electrostatic chuck 20. These contaminants that adhere to the electrostatic chuck 20 include, primarily, organic materials, etc., that were originally on the semiconductor wafers W themselves. When there is a buildup of this type of contaminant, the strength with which the electrostatic chuck 20 is able to chuck and secure the semiconductor wafer W is weakened, which may cause the wafer to shift out of position. Consequently, the electrostatic chuck 20 is cleaned after the film fabrication process is performed a specific number of times.

Figure 3:
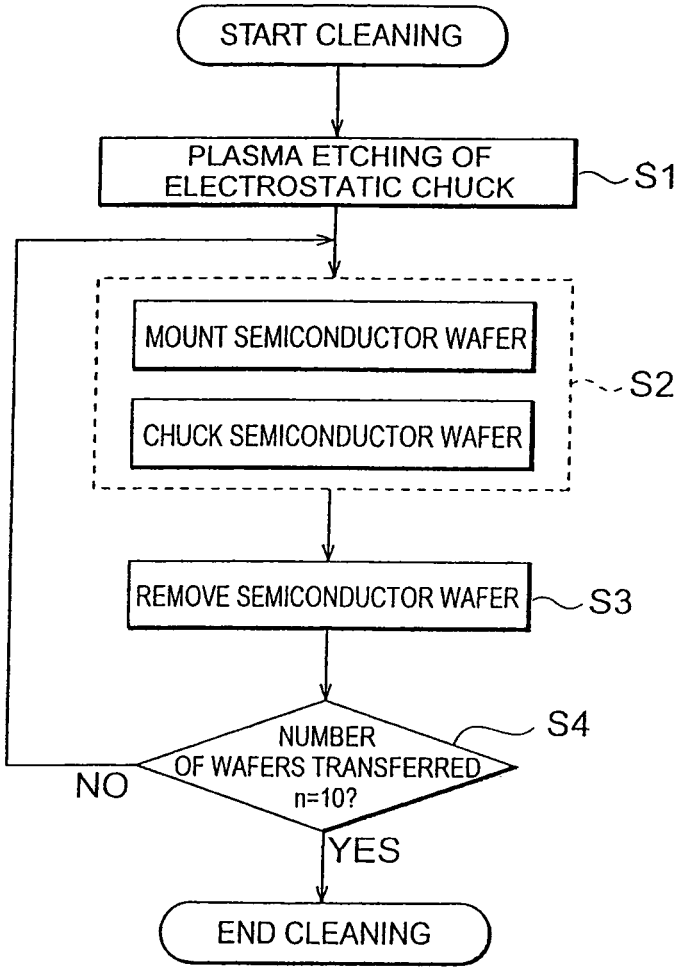
FIG. 3 is a flow chart showing the electrostatic chuck cleaning method according to an example of embodiment of the present invention.

FIG. 3 is a flow chart showing the cleaning process for the electrostatic chuck 20. In the cleaning, first, in step S1, the electrical potential of the base member 18 is dropped to ground when there is no semiconductor wafer W on the electrostatic chuck 20, while, at the same time, a high frequency power supply (13.56 MHz) 36 is used to apply power at about 75 to 95 W to the pair of electrodes 30. When this is done, a plasma discharge is caused over the electrostatic chuck 20, the argon ions impinge upon the electrostatic chuck 20, and the contaminants adhered to the electrostatic chuck 20 are subjected to plasma etching, detaching the contaminants. ("Plasma Etching Process").

Next, in step S2, the voltage that was applied by the high frequency power supply 36 is stopped, and a semiconductor wafer W is loaded onto the electrostatic chuck 20. ("Substrate Mounting Process") The mounting time for a single semiconductor wafer W is 10 seconds or less, and preferably only several seconds. In this way, mounting the semiconductor wafer W onto the electrostatic chuck 20, where the detached contaminants still remain, causes the contaminants to adhere to the semiconductor wafer W. At this point, it is preferable for the semiconductor wafer W to be mounted on the electrostatic chuck 20 in such a way that the mirror polished surface of the semiconductor wafer W is facing the electrostatic chuck 20. It has been confirmed experimentally that doing so makes it easier for the contaminants that have been detached from the electrostatic chuck 20 to adhere to the semiconductor wafer W.

Note that in the substrate mounting process it is preferable to secure the semiconductor wafer W by the chucking of the electrostatic chuck 20 by applying a voltage to the pair of electrodes 30 in the electrostatic chuck 20 from the DC power supply 34 in an amount that does not cause the semiconductor wafer W to over-chuck. ("Substrate Chucking Process") By doing this, it becomes easier for the contaminants that have been detached from the electrostatic chuck 20 to adhere to the semiconductor wafer W, physically because the wafer W is chucked by, and pressed against, the electrostatic chuck 20, and electrically because the contaminants are charged by the plasma etching. In addition, the semiconductor wafer W is secured by chucking, reducing the danger of slipping during transport.

Next, in step S3, the semiconductor wafer W, to which the contaminants have adhered, is removed from the electrostatic chuck 20. ("Substrate Removal Process") By doing so, the contaminants from the electrostatic chuck 20 are removed along with the semiconductor wafer W. Note that because, fundamentally, the semiconductor wafer W used in the cleaning is used for eliminating contaminants, it is removed from the process chamber 12 without having any type of process performed thereto.

After this, in Step S4, the number n of semiconductor wafers W that have been mounted onto, and then removed from, the electrostatic chuck 20 since the beginning of the cleaning process is calculated, and if this number n is less than a specific number of wafers, such as 10 wafers, the substrate mounting process and substrate removal process, described above, is repeated from step S2. ("Repeat Process") While the number of repeats is explained here as being 10 of the semiconductor wafers W, this number can be set as necessary, taking into consideration throughput and the cleanliness of the electrostatic chuck 20.

When the substrate mount process and substrate removal process are repeated as described above, the direction of the voltage applied to the electrostatic chuck 20 from the DC power supply 34 will, preferably, be reversed each time a new semiconductor wafer W is mounted onto the electrostatic chuck 20. Although the contaminants that have been detached from the electrostatic chuck 20 through plasma etching may be either positively or negatively charged, by reversing the direction of the voltage that is applied to the electrostatic chuck 20 each time a new semiconductor wafer W is loaded in the repeat process, it is possible to cause the contaminants to adhere adequately to the semiconductor wafer W regardless of the polarity of the charge of the contaminants so that the contaminants will be removed along with the semiconductor wafers W.

If the substrate mounting process and substrate removal process, as described above, are repeated and the number n of semiconductor wafers W that have been loaded onto, and removed from, the electrostatic chuck 20 since the commencement of cleaning reaches 10 wafers in step S4, then the cleaning process is terminated and the apparatus returns to the normal film fabrication process.

In the electrostatic chuck cleaning method in this example of embodiment, described above, it is possible to fully remove the contaminants that were adhered to the electrostatic chuck 20 by detaching the contaminants from the electrostatic chuck 20 through plasma etching, and causing the contaminants to adhere to the semiconductor wafer W, which is then removed. In addition, because there is no need to open the process chamber 12, it is possible to perform the cleaning on the electrostatic chuck 20 with extreme efficiency because there is no need to reduce substantially the vacuum level and no need to cool the electrostatic chuck 20.

Additionally, in the electrostatic chuck cleaning method according to this example of embodiment, it is easier to cause the contaminants that have been detached from the electrostatic chuck 20 to adhere to the semiconductor wafer W, and the efficiency of the removal of the contaminants is increased, because the semiconductor wafer W is loaded onto the electrostatic chuck 20 in such a way so as the mirror polish surface of the semiconductor wafer W is facing the electrostatic chuck 20.

Furthermore, in the electrostatic chuck cleaning method according to this example of embodiment, it is easier for the contaminants that have been detached from the electrostatic chuck 20 to adhere to the semiconductor wafer W, and so the efficiency of removal of the contaminants is increased further, physically because a voltage is applied to the electrostatic chuck 20 to chuck the semiconductor wafer W so that the semiconductor wafer W is pressed against the electrostatic chuck 20, and electrically because the contaminants are charged by the plasma etching.

Furthermore, in the electrostatic chuck cleaning method according to this example of embodiment, multiple semiconductor wafers Ware sequentially mounted onto the semiconductor chuck 20 and sequentially removed therefrom, making it possible to fully remove the contaminants, which have been detached from the semiconductor chuck 20, along with the semiconductor wafers W from said semiconductor chuck 20. At this point, as described above, the efficiency with which the contaminants are removed on a per-semiconductor wafer W basis is improved by mounting the semiconductor wafer W onto the electrostatic chuck 20 in such a way that the mirror polished surface of the semiconductor wafer W is facing the electrostatic chuck 20, and by applying a voltage to the electrostatic chuck 20 in order to cause the electrostatic chuck 20 to chuck the semiconductor wafer W, it is possible to reduce the number of semiconductor wafers W that are used for the cleaning, thereby controlling the waste of the semiconductor wafers W.

In addition, in the electrostatic chuck cleaning method according to this example, the direction in which, the voltage is applied to the electrostatic chuck 20 is reversed each time a new semiconductor wafer W is loaded onto the electrostatic chuck 20. In this manner, it is possible to cause the contaminants that have been detached from the electrostatic chuck 20 by the plasma etching to adhere fully to the semiconductor wafer W, regardless of the polarity with which the contaminant is charged, in order to remove the contaminant along with the semiconductor wafer W.

Note that this invention is not limited to the embodiment described above, but rather it is possible to change its form in a variety of ways. For example, although in the example of embodiment described above an explanation was given for a method of cleaning an electrostatic chuck that is equipped in a sputtering apparatus, this invention applies to cleaning electrostatic chucks that are equipped in other types of apparatus as well.

As described above, this invention provides an electrostatic chuck cleaning method that is able to efficiently and completely remove contaminants from an electrostatic chuck. By improving the efficiency of the cleaning, it is possible to improve the efficiency of processing when many substrates are processed, and possible to perform stable processing by securely adhering the substrates by sufficiently removing the contaminants.

While the foregoing is directed to embodiments of the present invention, other and further embodiments of the invention may be devised without departing from the basic scope thereof, and the scope thereof is determined by the claims that follow.

The invention claimed is:

1. A method for removing one or more particles from an electrostatic chuck disposed in a plasma chamber, comprising:

exposing an upper surface of the electrostatic chuck to a plasma;

placing n substrate(s) each having a mirror polished surface on the upper surface of the electrostatic chuck, wherein the one or more particles are between the upper surface and the mirror polished surface;

applying a voltage to the electrostatic chuck such that the n substrate(s) is attracted to the upper surface; and removing the n substrate(s) from the electrostatic chuck without processing the n substrate(s), wherein the one or more particles are adhered to the mirror polished surface of the n substrate(s).

2. The method of claim 1, wherein n equals one substrate.

3. The method of claim 1, wherein n equals two substrates.

4. The method of claim 3, wherein the voltage applied to the electrostatic chuck is different for each of the two substrates.

5. The method of claim 1, wherein n equals three substrates and the voltage applied to the electrostatic chuck is different for the second substrate and the same for the first and third substrate.

* * * * *

UNITED STATES PATENT AND TRADEMARK OFFICE

CERTIFICATE OF CORRECTION

PATENT NO. : 8,454,758 B2
APPLICATION NO. : 11/332706
DATED : June 4, 2013
INVENTOR(S) : Akiba It is certified that error appears in the above-identified patent and that said Letters Patent is hereby corrected as shown below:

In Detailed Description:

Column 3, Line 46, delete "equipped".

Signed and Sealed this
Twentieth Day of August, 2013

Teresa Stanek Rea
*Acting Director of the United States Patent and Trademark Office*